US008496366B2

(12) United States Patent
Leong

(10) Patent No.: US 8,496,366 B2
(45) Date of Patent: Jul. 30, 2013

(54) HAND-HELD POWER TOOL

(75) Inventor: Chi Hoe Leong, Bayan Lepas (MY)

(73) Assignee: Robert Bosch GmbH, Stuttgart (DE)

( * ) Notice: Subject to any disclaimer, the term of this patent is extended or adjusted under 35 U.S.C. 154(b) by 312 days.

(21) Appl. No.: 12/638,378

(22) Filed: Dec. 15, 2009

(65) Prior Publication Data

US 2010/0149790 A1 Jun. 17, 2010

(30) Foreign Application Priority Data

Dec. 16, 2008 (EP) ..... 08105996

(51) Int. Cl.
*F21V 33/00* (2006.01)

(52) U.S. Cl.
USPC ..... 362/577; 362/35; 362/109; 362/446

(58) Field of Classification Search
USPC ..... 362/577, 578, 35, 109, 120, 446
See application file for complete search history.

(56) References Cited

U.S. PATENT DOCUMENTS

| | | | | |
|---|---|---|---|---|
| 4,078,869 | A * | 3/1978 | Honeycutt | 408/16 |
| 4,283,757 | A * | 8/1981 | Nalbandian et al. | 362/120 |
| 7,934,847 | B2 * | 5/2011 | Oomori et al. | 362/119 |
| 2004/0264178 | A1 * | 12/2004 | Hsu | 362/119 |
| 2005/0132589 | A1 * | 6/2005 | Johnson | 33/286 |
| 2006/0262519 | A1 * | 11/2006 | Hirschburger et al. | 362/119 |
| 2008/0025017 | A1 * | 1/2008 | Tadokoro et al. | 362/119 |
| 2008/0074865 | A1 * | 3/2008 | Lutz et al. | 362/119 |

FOREIGN PATENT DOCUMENTS

| | | | |
|---|---|---|---|
| DE | 202005021270 | U1 | 8/2007 |
| EP | 1477282 | A1 | 11/2004 |
| EP | 1882553 | A2 | 1/2008 |
| WO | 2008133339 | A1 | 11/2008 |

* cited by examiner

*Primary Examiner* — Jong-Suk (James) Lee
*Assistant Examiner* — Leah S Macchiarolo
(74) *Attorney, Agent, or Firm* — Kenyon & Kenyon LLP

(57) ABSTRACT

A hand-held power tool comprising an output shaft rotatable around a tool axis of rotation, a tool housing portion radially disposed relative to the output shaft, an illuminating element for illuminating a work area of the tool, a lens positioned adjacent the illuminating element, and a cover that secures the lens and the illuminating element to the tool housing portion. At least a portion of the cover is closer to the axis of rotation than the lens is to the axis of rotation.

25 Claims, 4 Drawing Sheets

HAND-HELD POWER TOOL

CROSS-REFERENCE TO RELATED APPLICATION

This application is based on EP Application 08105996.6 filed on Dec. 16, 2008.

BACKGROUND OF THE INVENTION

1. Field of the Invention

The present invention relates to means for illuminating the work area of a hand-held power tool. It has become common for hand-held power tools to include integrated illumination means to permit use even under poor lighting conditions. However it is has been challenging from a design standpoint to simultaneously achieve effective illumination of the work area alongside other design goals, since these hand-held tools should also be compact, light, and especially in the case of cordless tools, energy efficient.

2. Description of the Prior Art

One solution directed towards drilling/driving tools involves positioning small and lightweight LED's as near as possible to the tool insert for illuminating the immediately adjacent work area. For example, US 2008/0074865 A1 describes incorporating a PCB ring holding multiple LED units into the nose of a drill/driver. But this position presents certain design challenges. The illumination area tends to be smaller than with more remotely positioned light sources. The tool holder and tool insert may obscure the light sources. If lenses are used, their position close to the work piece subjects them to possible damage from dirt or debris. In practice, the nose of a tool is more likely to be involved in collisions with other objects such as the work piece itself. During use, vibrations are generated by the action of the tool insert. In the case of an impact driver, the impact mechanism is nearby, creating shocks in the tool nose. Such vibrations and shocks may compromise the stability and durability of the illumination assembly. It would be useful to enjoy the advantages of proximity without the corresponding disadvantages.

ADVANTAGES AND SUMMARY OF THE INVENTION

A hand-held power is described which may be, for example, a drill/driver or impact driver. The tool is provided with an output shaft rotatable around a tool axis of rotation, a tool housing portion radially disposed relative to the output shaft, an illuminating element for illuminating a work area of the tool, a lens positioned adjacent the illuminating element, and a cover that secures the lens and the illuminating element to the tool housing portion. A portion of the cover is closer to the axis of rotation than the lens is to the axis of rotation. In such a configuration, the cover can actually wrap around the lens so as to better secure the lens and illuminating element to the nose of the tool.

If at least a portion of tool housing portion is positioned between the output shaft and the lens, the tool housing portion may advantageously protect the illuminating element and lens from the output shaft. Positioning of the tool housing portion in this way provides structural support for the illuminating element and lens while permitting these elements to be moved out radially relative to the axis of rotation in comparison with prior art designs.

Preferably at least a second illuminating element and at least a second lens are further provided. Multiple illuminating elements have the advantage that shadows created by nearby aspects of the tool nose are cancelled out. That is, one illuminating element might illuminate a portion of the work piece that is lies in a shadow with respect to another illuminating element. Naturally it is preferable if each illuminating element is provided with its own lens element to help guide the light rays and protect the illuminating element.

If the multiple illuminating elements and multiple lenses are arranged symmetrically about the axis of rotation, the illumination will be more uniformly distributed at the work piece. Because it is impossible to position a light directly along the axis of rotation when using an opaque tool insert, the more illuminating elements that are symmetrically distributed about the axis of rotation, the greater the uniformity of the overall illumination pattern.

It is preferable to form the cover out of a soft flexible material. This will protect the nose of the tool and any lenses from collisions or contact with foreign objects. Furthermore, since the cover is in contact with the lens and in indirect contact with the illuminating elements and their support member, the cover helps to reduce the impact of vibrations generated by the tool insert while using the tool. When an impact driver or other percussion tool is used, the cover can help to absorb some of the shock generated by engagement of the impact or percussion mechanism.

If the cover generally surrounds the axial and radial face of the tool housing, then it is not necessary to use additional elements for securing the cover to the housing, since the cover can achieve a snug fit with these elements. This advantage is even better realized if the cover is made of a flexible material.

To best protect the lens elements, the cover is advantageously positioned to surround each lens element. Hence the cover is provided with slots through which the lens elements may transmit light from the illuminating elements. In this configuration, at least a portion of the cover is positioned nearer the axis of rotation than the lens or the illuminating element or its support member. This configuration ensures that the lens is well secured to the tool, thereby preventing drop out It also prevents damage to the lens from scratches that might otherwise come from any angle of approach. Each slot in the cover preferably makes a snug fit with each lens element so as to protect against entry of dirt and dust.

To support and position each illuminating element, each is preferably attached to a generally ring-shaped and generally non-flexible, rigid support member. The ring-shape ensures that the illuminating elements are equidistant from the axis of rotation. The non-flexible nature provides support so that the illuminating elements remain fixed in position even under the stresses of use.

It is advantageous to provide a damping member between the support member that holds the illuminating elements—preferably a printed circuit board (PCB)—and the tool housing. When the support member is furthermore made of a flexible material, it might also protect the PCB by absorbing vibrations arising from the tool insert or from the gear transmission or motor. It also serves to dampen shocks that might create stress on the PCB if there is an impact or percussion mechanism in the tool. It is advantageous if the support member is also made of insulating material, since it can then act as a thermal barrier to insulate the PCB and its associated elements against heat generated by the gear transmission and motor.

For positioning the and better supporting the damping member, it is advantageous if the damping member, like the support member, is generally ring-shaped.

If the lens is integral with a ring-shaped lens assembly element then a compound element with multiple lens portions can be conveniently formed in one solitary piece. Like the support member and the damping member, it is preferable if this solitary lens assembly is ring shaped. When such a ring shape is provided, the cover will advantageously cover a portion of the lens assembly, so that it and the other ring-shaped elements are well within the tool.

It is preferable to have a larger lens so as to transmit more light from the illuminating elements. If the lens assembly has a ring shape, then the lens is preferably formed in an arc shape. The arc-shaped lens when positioned directly in front of an illuminating element can serve as a light pipe to distribute the light rays and lead them through the cover. It is preferable if the arc length is greater than or equal to 2 times a length of said illuminating element. This still provides portions of lens assembly without lens elements that can be used by the cover to apply pressure to secure the lens assembly.

In order to accommodate and protect these ring-shaped elements, it is preferable if the tool housing, particularly the portion of the housing in the nose of the tool that is radially disposed relative to the output shaft, is provided with an annular cavity. Hence during assembly, the damping member, support member and illuminating element can be conveniently positioned within the annular cavity. When the cover wraps around the housing portion, it therefore serves to trap these elements in the annular cavity.

This has the advantage that the tool housing can secure and protect these elements. If at least a portion of the lens is recessed into the annular cavity, it will also receive protection and be better fixed into position by the tool housing.

Relative to prior art solutions wherein the illumination elements were provided very near to the tool fitting and the axis of rotation, it is much more advantageous to move the illumination elements further away. This creates an overall larger illumination zone and furthermore reduces the amount of shadows and blocking of the illumination caused by the tool fitting and tool insert. Preferably the ratio of a diameter of the support member and a diameter of such a tool fitting is greater than or equal to 1.5.

One can determine a nearest point on the axis of rotation that is in a line-of-sight towards the lenses with respect to obstruction from the tool fitting. There is thereby an angle formed between the axis of rotation and said line-of-sight. It is advantageous if this angle is greater than or equal to 25 degrees so that an even larger cone of light arising from the lens is unobstructed. A still larger angle is preferable since a larger angle means that more light from the illuminating element will reach the work piece unobstructed.

It is preferable if the illuminating elements are light emitting diode (LED) units. LED's have the advantage that a small and power-sparing unit can still give off bright light. The nature of LED's is that they are also very damage-resistant, and this is an advantage considering their proximity to the working end of the power tool.

BRIEF DESCRIPTION OF THE DRAWINGS

The invention will be described in further detail below taken in conjunction with the drawings, in which.

DESCRIPTION OF THE PREFERRED EMBODIMENT

Figure 1:
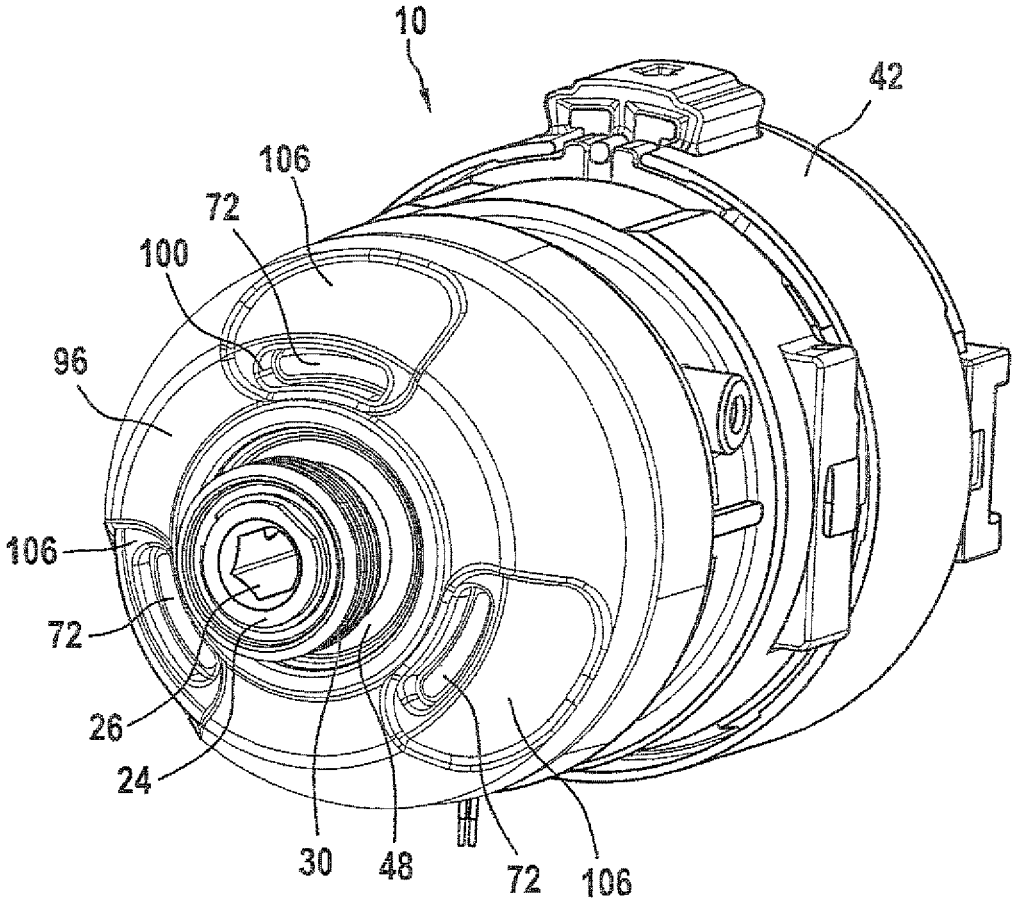
FIG. 1 is a perspective view of a nose portion of a hand-held power tool according to the present invention.
Figure 2:
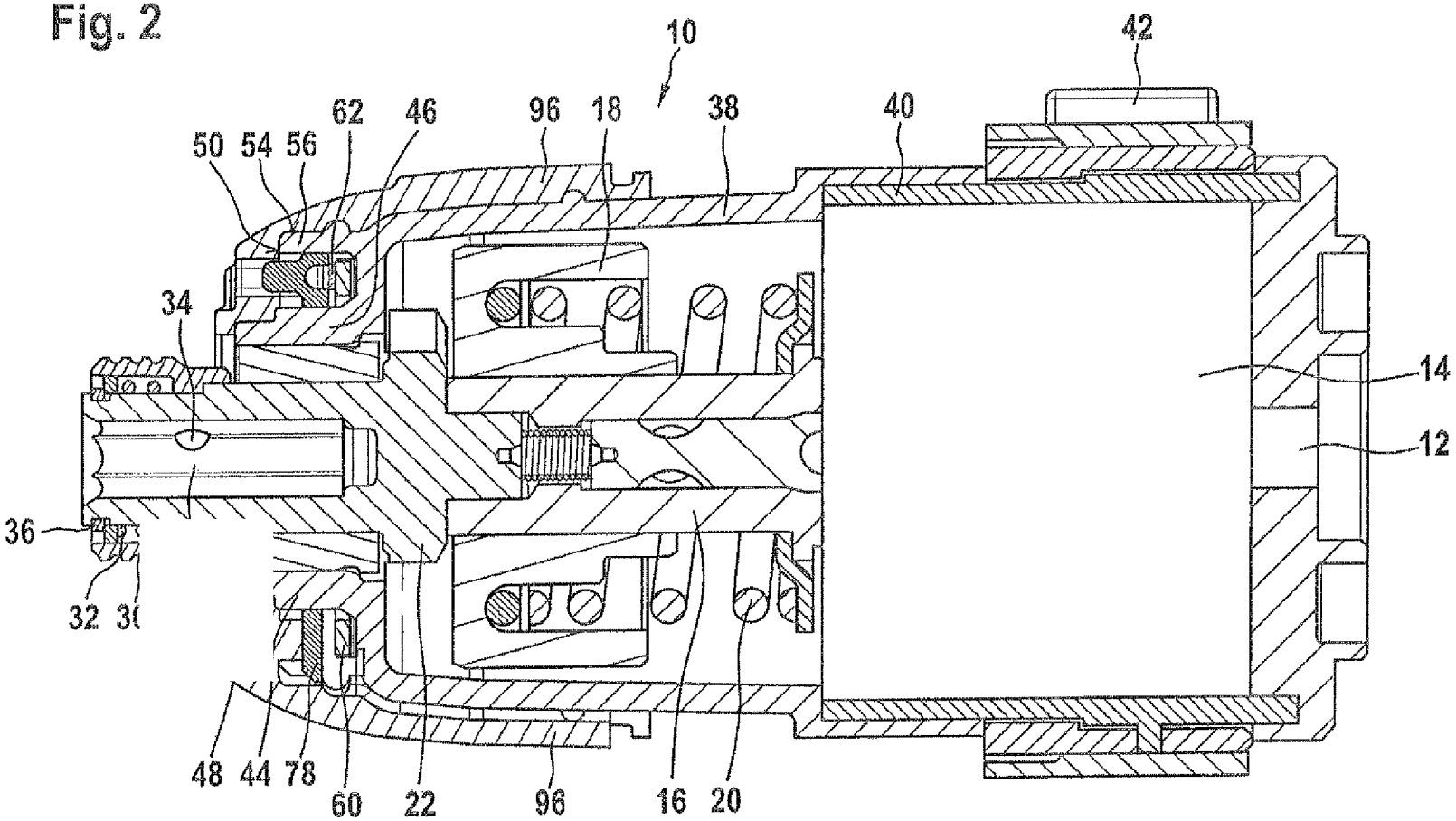
FIG. 2 is a section view of a nose portion of a hand-held power tool of FIG. 1.

Just the nose portion 10 of a hand-held power tool of the sort used for drilling and/or driving is shown in FIGS. 1 and 2. Since these tools are commonplace, aspects of these tools not relevant to the invention, such as a handle, motor and motor housing are not illustrated. The tool may be provided either with a power cord for drawing AC power or may incorporate an intrinsic or removable rechargeable DC battery.

Torque from the motor is transmitted via a pinion gear 12 through a gear transmission 14 to rotate an intermediate shaft 16. Since the illustrated tool is an impact driver, it is provided with a conventional impact mechanism assembly comprising among other things a striker 18, a spring 20 and an anvil 22 for providing high torque impacts. Anvil 22 is integral with an output shaft 24 which is provided with a cavity 26 for receiving a tool insert. Output shaft 24 rotates around a tool axis of rotation 28 (FIG. 4) and is provided with a sleeve 30, a spring 32, a locking ball 34 and a retaining ring 36 which together comprise a tool fitting for retaining such tool inserts.

Generally surrounding the impact mechanism is a striker housing 38 that extends to overlap a gearbox housing 40. A rotatable collar 42 surrounds gearbox housing 40 for allowing user adjustment to the impact mechanism and/or other functional aspects of the hand-held tool. There is a housing portion 44 that is contiguous with the striker housing 38 but which is forward of the impact mechanism. Inner housing subportion 46 of housing portion 44 embraces a bushing 48 that supports output shaft 24.

Extending into an axial face 50 of housing portion 44 is an annular cavity 52 (FIG. 4) which is coaxial with respect to axis of rotation 28 and rotary shaft 24. In a plane perpendicular to axis of rotation 28, annular cavity 52 is largely sealed off with respect to a radial face 54 extending around the full perimeter of housing portion 44 by distal housing subportion 56 of housing portion 44. However, on the underside of the nose portion 10 is a notch 58 (FIG. 4) which traverses distal housing subportion 56 in this plane.

Figure 3:
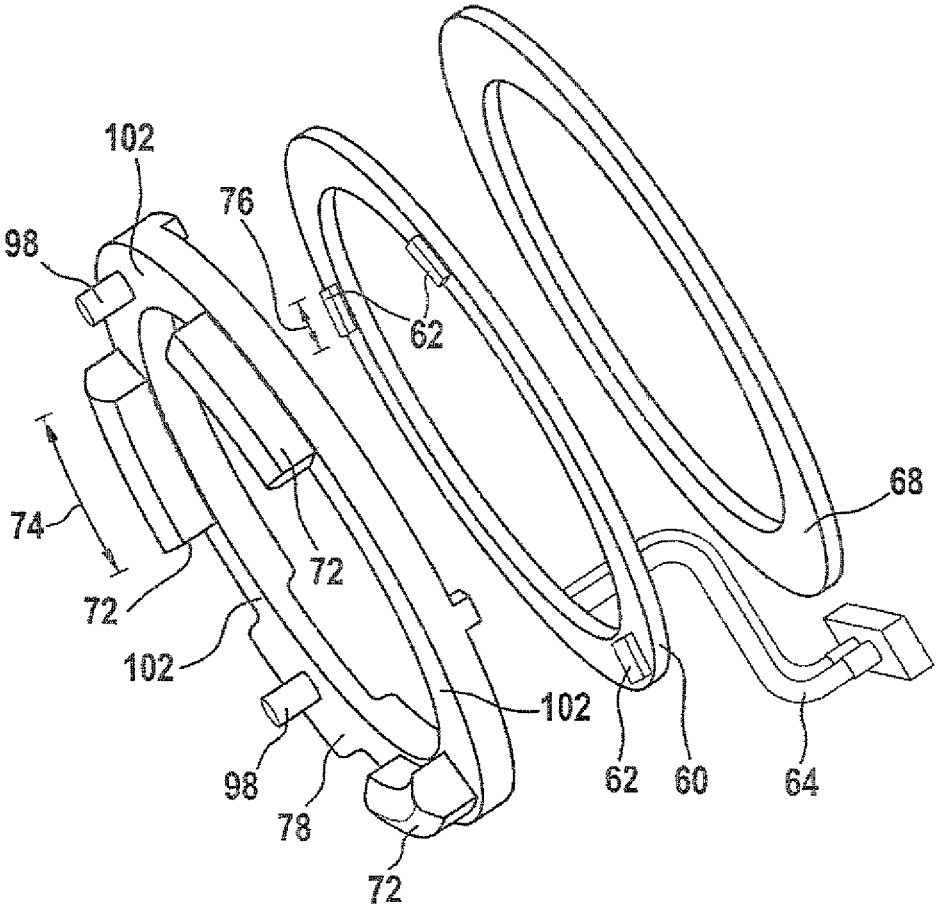
FIG. 3 is a perspective exploded view of a certain subcomponents of one embodiment of the hand-held power tool.

Seated within annular cavity 52 is an annular printed circuit board (PCB) 60 which serves as a support member for mounting three LED units 62 that act as illuminating elements. As an alternative, two, four, five, six, seven or even more LED units 62 may be provided, but they should be arranged symmetrically around annular PCB 60. Alternatively only a single LED unit 62 may be provided. Although it can be arranged in any position, it is preferably positioned on the underside of tool nose 10. PCB 60 is by its nature stiff and sturdy and forms a platform for establishing electrical connections (not shown) with the LED units 62 and for connecting via cable 64 to the remaining circuitry of the hand-held power tool (see FIG. 3). Hence via cable 64, the activation and deactivation of LED units 62 can be achieved. Cable 64 extends radially from PCB 60 and passes through notch 58 thereby also serving to maintain the orientation of PCB 60 in annular cavity 52.

Optionally but preferably, an annular pad 68 may be provided in the space between annular PCB 60 and floor 66 (FIG. 4) of annular cavity 52. Pad 68 serves as a damping means for vibrationally isolating annular PCB 60. So that is can absorb vibrations, pad 68 is preferably made of soft, dampening material, such as rubber, elastomeric polymers, elastomeric rubber, ethylene-propylene-diene rubber, or other similar materials. So that it can provide a thermal barrier to insulate PCB 60 from heat, pad 68 is preferably made of a material having low thermal conductivity.

Positioned in front of the LED units 62 is a transparent ring (not enumerated) that has been provided with three lens portions 72 that refract and guide light emitted by the LED units 62. Less or more lens portions 72 may be provided to correspond with the number of LED units 62. So that the work piece will be broadly illuminated, it is preferable if the lens portion 72 is a gently diverging lens as in the illustrated negative meniscus lens. Alternatively the lens portion can be configured to provide gentle convergence of light rays or no bending of light rays at all. For the purposes of this description, a transparent element that is positioned near the illuminating element will be considered a "lens" even if there is little or no bending of light rays, such as would be the case if the inner and outer surfaces of the lens had an identical curved shape.

Because there are multiple LED units 62 and lens portions 72, the pattern of emitted light overlap so that the central portion of the combined pattern is particularly well-illuminated. In other words, light rays summate near the axis of rotation 28 precisely where a tool insert would contact the work piece. Depending on the source of illumination, it may be preferable for the lens to diverge or converge the light rays even more so, whichever is necessary to generate a generally uniform pattern of illumination with light rays concentrated preferably in the center of the pattern.

Each of the lens portions 72 is arc-shaped and has an arc length 74 significantly greater than the length 76 of LED units 62. The ratio of arc length 74 to length 76 is 3:1 in the preferred embodiment and is any case preferably greater than 2:1 and creates a light pipe effect which distributes light along the arc shape of each lens portion 72. An extension 78 of transparent ring protrudes into notch 58 and therefore helps to orient this part within annular cavity 52.

Although it is preferred, neither PCB 60 nor pad 68 nor ring needs to necessarily take on a full ring shape. They should be arc-shaped so that they can be positioned within annular cavity 52 but could assume, for example, a general horseshoe shape while still providing a platform for orienting multiple LED units 62.

So that the quantity and quality of the light generated at the work piece by the structure described in the foregoing is improved, the ring-shaped elements are preferably significantly larger in diameter than the diameter of the output shaft 24 and the elements, particularly the sleeve 30 which comprise its tool fitting. In the preferred embodiment a diameter 80 of PCB 60 is twice as large as a diameter 82 of sleeve 30 (see FIG. 4). These dimensions will help determine the nearest point 84 along the axis of rotation 28 which receives unobstructed light emitted from lens portion 72. There is a distance 86 from this point 84 to the end surface 88 of rotary shaft 24 and ideally this distance is less than the length of a typical tool insert. In the preferred embodiment, this distance 86 is approximately 1.5× the length 90 between end surface 88 and a center of locking ball 34 and approximately 2× the width 92 of the cavity 26. Note that point 84 also establishes an angle 94 that is in this example 35 degrees, but is at a minimum preferably greater than 25 degrees.

The lighting assembly is retained within annular cavity 52 by a cover 96. Cover 96 is symmetrically arranged around axis of rotation 28 and has a minimum diameter that is greater than the diameter of bushing 48 so that bushing 48 is exposed at the front of the nose portion 10. Moving from front to rear, cover 96 extends almost completely around the rest of nose portion 10, generally surrounding axial face 50 and radial face 54 of housing portion 44 as well as approximately one half of the otherwise exposed surface of striker housing 38.

Cover 96 mates snugly with two protrusions 98 which are provided on transparent ring. Because it covers so large a housing surface area, no other specific fastening means are required to secure cover 96 to the hand-held tool other than the fact that it is constructed of a material capable of flexing resiliently to provide a snug fit onto nose portion 10. A soft, flexible material, also has shock-absorbing qualities which helps protect nose portion 10 against collisions, etc. Therefore, like pad 68, cover 96 is preferably made of soft, dampening material, such as rubber, elastomeric polymers, elastomeric rubber, ethylenepropylene-diene rubber, or other similar materials.

Figure 4:
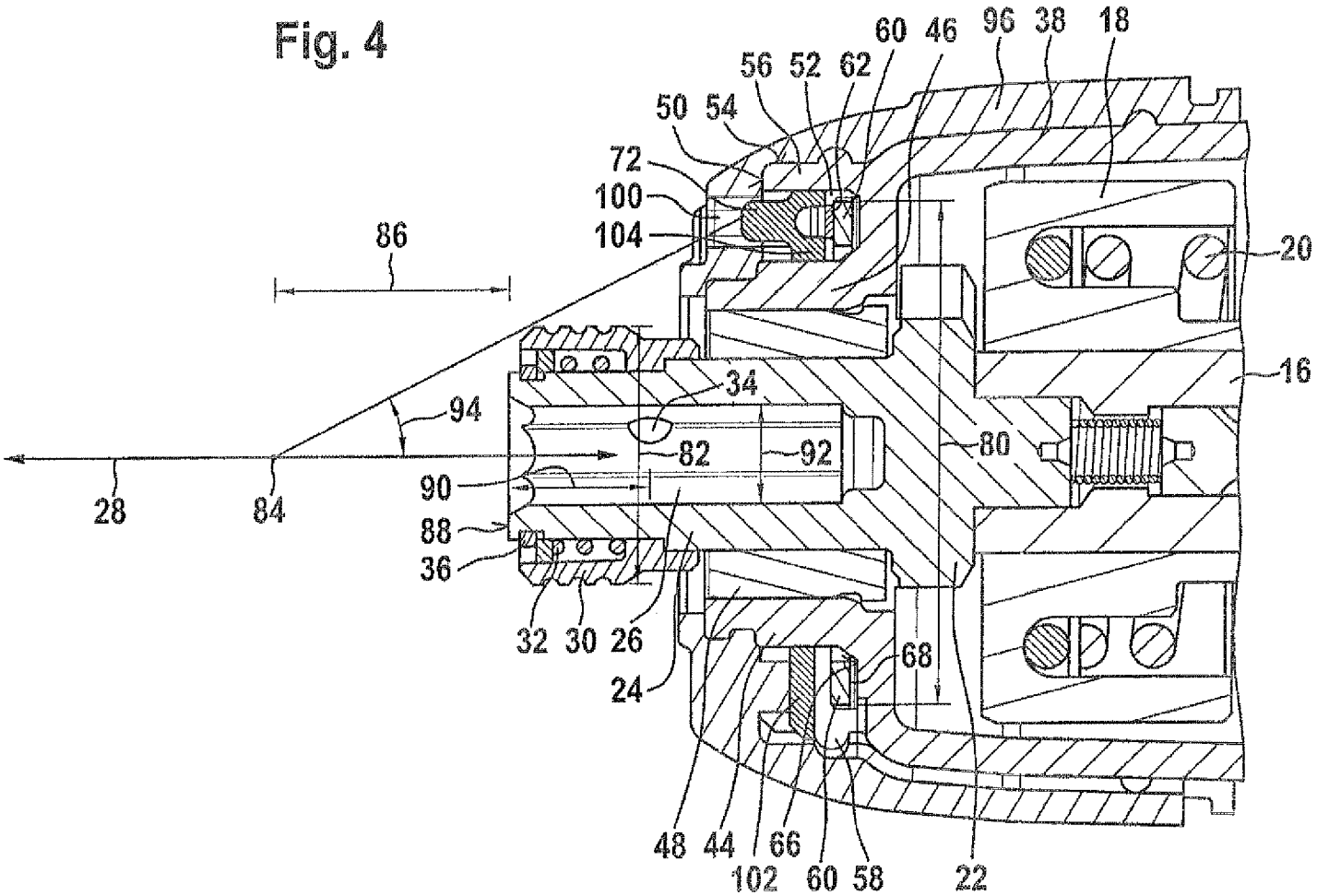
FIG. 4 is a larger version of a portion of the section view of FIG. 2.

Slots 100 are provided in cover 96 to provide windows for light to exit through lens portions 72 (see FIG. 4). Cover 96 retains transparent ring including its lens portions 72 onto housing portion 44 primarily via contact with ring portions 102 of transparent ring. Since transparent ring abuts PCB 60 and pad 68, these elements are also retained by cover 96. Slots 100 abut the lens portions 72 to maintain a barrier stopping light or dust from entering between cover 96 and lens portions 72. Unlike slots 100, base portions 104 have greater width than corresponding lens portions 72 and therefore traverse the full width of annular cavity 52.

Lens portions 72 have significant axial thickness and act as a light pipe to guide light rays through the axial thickness of cover 96. For maximum light throughput, lens portions 72 are best positioned flush with cover 96. However, so that they are better protected in case of collision with the nose 10 of the tool, it is preferred to position the lens portions 72 somewhat recessed from cover 96. The flexibility of cover 96 permits portions near slots 100 to fold over somewhat and protect the lens portions 72 when contact is made with a foreign object.

As still a further measure of protection against inadvertent collisions, discrete recessed portions 106 of cover 96 that are nearest slots 100 are recessed relative to the rest of cover 96. That is, the majority of cover 96 extends further from the hand-held tool than the limited recessed portions 106.

The foregoing relates to the preferred exemplary embodiment of the invention, it being understood that other variants and embodiments thereof are possible within the spirit and scope of the invention, the latter being defined by the appended claims.

The invention claimed is:

1. A hand-held power tool comprising:

an output shaft rotatable around a tool axis of rotation;

a tool housing portion radially disposed relative to the output shaft;

at least one first illuminating element for illuminating a work area of the tool;

at least one first lens positioned adjacent the at least one first illuminating element; and a cover that secures the at least one lens and the at least one first illuminating element to the tool housing portion, at least a portion of the cover being closer to the axis of rotation than the at least one first lens is to the axis of rotation, wherein the at least one first illuminating element is attached to a rigid support member and a flexible damping member is positioned between the support member and the tool housing portion, wherein the rigid support member is a printed circuit board.

2. A hand-held power tool according to claim 1, wherein at least a portion of tool housing portion is positioned between the output shaft and the at least one first lens.

3. A hand-held power tool according to claim 2, wherein the housing portion has an annular cavity and the damping member, the support member, and the at least one first illuminating element are positioned within the annular cavity.

4. A hand-held power tool according to claim 3, wherein at least a portion of the at least one first lens is positioned within the annular cavity.

5. A hand-held power tool according to claim 4, wherein the at least one first lens is generally arc-shaped, extending along a path which if continued would extend so as to encircle the output shaft, and wherein the arc length of the at least one first lens is greater than the arc length of the at least one first illuminating element.

6. A hand-held power tool according to claim 5, wherein an arc length of the at least one first lens is equal to or greater than 2 times a length of the at least one first illuminating element.

7. A hand-held power tool according to claim 6, wherein at least one second illuminating element is provided and at least one second lens is positioned adjacent the at least one second illuminating element, wherein the at least one first and second illuminating elements are positioned on a circular support, which circular support encircles the output shaft, and the at least one first and second lenses are also positioned in a circular arrangement which encircles the output shaft.

8. A hand-held power tool according to claim 7, wherein the cover is made of a flexible material.

9. A hand-held power tool according to claim 1, wherein the housing portion has an annular cavity and the damping member, the support member, and the at least one first illuminating element are positioned within the annular cavity.

10. A hand-held power tool according to claim 9, wherein at least a portion of the at least one first lens is positioned within the annular cavity.

11. A hand-held power tool according to claim 1, wherein the at least one first lens is generally arc-shaped, extending along a path which if continued would extend so as to encircle the output shaft, and wherein the arc length of the at least one first lens is greater than the arc length of the at least one first illuminating element.

12. A hand-held power tool according to claim 11, wherein an arc length of the at least one first lens is equal to or greater than 2 times a length of the at least one first illuminating element.

13. A hand-held power tool according to claim 1, wherein at least one second illuminating element is provided and at least one second lens is positioned adjacent the at least one second illuminating element, wherein the at least one first and second illuminating elements are positioned on a circular support, which circular support encircles the output shaft, and the at least one first and second lenses are also positioned in a circular arrangement which encircles the output shaft.

14. A hand-held power tool according to claim 1, wherein the cover is made of a flexible material.

15. A hand-held power tool according to claim 1, wherein the tool housing portion has an axial face and a radial face and the cover generally surrounds the axial face and the radial face.

16. A hand-held power tool according to claim 1, wherein the cover is provided with a slot through which the at least one first lens transmits light from the at least one first illuminating element.

17. A hand-held power tool according to claim 1, wherein a tool fitting is provided for coupling a tool insert to the output shaft and a ratio of a diameter of the support member and a diameter of the tool fitting is greater than or equal to 1.5.

18. A hand-held power tool according to claim 1, wherein there is a point on the axis of rotation having a line-of-sight towards the lens which is nearest to the tool housing portion, and an angle formed between the axis of rotation and the line-of-sight is greater than or equal to 25 degrees.

19. The hand-held power tool according to claim 1, wherein the printed circuit board is annular-shaped.

20. The hand-held power tool according to claim 1, wherein the flexible damping member is annular-shaped.

21. The hand-held power tool according to claim 1, wherein the flexible damping member protects the PCB from vibration impact.

22. A hand-held power tool comprising:

an output shaft rotatable around a tool axis of rotation;

a tool housing portion radially disposed relative to the output shaft;

at least one first illuminating element for illuminating a work area of the tool;

at least one first lens positioned adjacent the at least one first illuminating element; and a cover that secures the at least one lens and the at least one first illuminating element to the tool housing portion, at least a portion of the cover being closer to the axis of rotation than the at least one first lens is to the axis of rotation, wherein the at least one first lens is provided on a lens support member, the at least one first illuminating element is attached to a rigid support member and a flexible damping member is positioned between the support member and the tool housing portion, wherein the lens support member is annular-shaped.

23. The hand-held power tool according to claim 22, wherein the flexible damping member is made of insulating material having low thermal conductivity for insulating the rigid support member from heat.

24. A hand-held power tool comprising:

an output shaft rotatable around a tool axis of rotation;

a tool housing portion radially disposed relative to the output shaft;

at least one first illuminating element for illuminating a work area of the tool;

at least one first lens positioned adjacent the at least one first illuminating element; and a cover that secures the at least one lens and the at least one first illuminating element to the tool housing portion, at least a portion of the cover being closer to the axis of rotation than the at least one first lens is to the axis of rotation, wherein the at least one first lens is provided on a lens support member, the at least one first illuminating element is attached to a rigid support member and a flexible damping member is positioned between the support member and the tool housing portion, wherein the lens support member is a transparent ring.

25. The hand-held power tool according to claim 24, wherein the flexible damping member is made of insulating material having low thermal conductivity for insulating the rigid support member from heat.

* * * * *